United States Patent [19]

Eggmann

[11] 4,265,594

[45] May 5, 1981

[54] TURBINE BLADE HAVING HEAT LOCALIZATION SEGMENTS

[75] Inventor: Jean Eggmann, Baden, Switzerland

[73] Assignee: BBC Brown, Boveri & Co., Ltd., Baden, Switzerland

[21] Appl. No.: 15,890

[22] Filed: Feb. 28, 1979

[30] Foreign Application Priority Data

Mar. 2, 1978 [CH] Switzerland ..... 2252/78

[51] Int. Cl.[3] ..... F01D 11/08

[52] U.S. Cl. ..... 416/193 A; 416/95; 416/198 A

[58] Field of Search ..... 416/193 A, 196 R, 95, 416/198 A

[56] References Cited

U.S. PATENT DOCUMENTS

| | | | |
|---|---|---|---|
| 2,858,103 | 10/1958 | Waugh | 416/193 A |
| 3,066,910 | 12/1962 | Bluck | 416/193 A |
| 3,597,109 | 8/1971 | Petrie et al. | 416/193 A |
| 3,719,431 | 3/1973 | Steele et al. | 416/95 X |
| 3,761,200 | 9/1973 | Gardiner | 416/193 A |
| 3,801,220 | 4/1974 | Beckershoff | 416/193 A |
| 3,905,722 | 9/1975 | Guy | 416/196 X |
| 4,022,544 | 5/1977 | Garkusha et al. | 416/193 R |

FOREIGN PATENT DOCUMENTS

| | | | |
|---|---|---|---|
| 2816791 | 11/1978 | Fed. Rep. of Germany | 416/193 A |
| 2813834 | 9/1979 | Fed. Rep. of Germany | 416/95 |
| 809268 | 2/1959 | United Kingdom | 416/193 A |
| 1236920 | 6/1971 | United Kingdom | 416/193 A |

*Primary Examiner*—Everette A. Powell, Jr.
*Attorney, Agent, or Firm*—Burns, Doane, Swecker & Mathis

[57] ABSTRACT

Turbine blades having heat localization segments, especially for use in gas turbines, are disclosed. The segments are provided with covering elements in the form of thin cover plates that are supported against the blade root. The segments are formed as one piece together with both the actual blade and with reinforcing elements. The segments are used to impede access of a hot working medium to the turbine rotor.

6 Claims, 3 Drawing Figures

TURBINE BLADE HAVING HEAT LOCALIZATION SEGMENTS

BACKGROUND AND SUMMARY OF THE PRESENT INVENTION

In present-day gas turbines which operate at very high gas temperatures and in order to provide as high an efficiency as possible, a rotor body of a turbine carrying the rotation blading typically must be shielded with respect to the gases of combustion.

In the known prior art, it had been customary to provide a drum rotor which was completely satisfactory at lower heat and stability stresses. At the present time, however, rotors which are composed of individual rotor disks that are welded together in circumferential directions are used in gas turbine plants. In the turbine plants of today, the rotors are subject to higher stresses, essentially both thermal and mechanical.

In disks which are welded together at an outside diameter, a gap between two neighboring rotor blade rows is protected by separate heat localization segments which shield the entire circumference of the gaps. These heat localization segments customarily consist of the same highly heat-resistant material as the blades and like the blades are mounted in circumferential slots of the rotor by fir cone roots. The heat localization segments of this type necessitate a high production requirement and correspondingly high costs.

In gas turbines working at relatively higher circumferential velocities, the disks are, for reasons of stability, welded together along ring-shaped projections. The diameter of the ring-shaped projections is less than the outside diameter of the disks. The radius of the ring-shaped projections is selected such that a diameter change of the ring owing to the centrifugal force is equal to a change in diameter of the rotor disks at the welding point. In this way, the rotor disks are not additionally loaded by reason of the centrifugal force of the rings.

Indeed, with such a rotor arrangement, guide wheel bases are specified in the circular spaces outwardly from these ring-shaped projections in order to separate two neighboring guide wheel stages from each other. In the event of a too large play of the guide wheel base with respect to the rotor, the guide wheel base is streamed with hot gas whereby the guide wheel base and shaft can be overheated. In the event of a guide blade fracture caused thereby, considerable damage to the expensive rotor body in certain circumstances must be anticipated.

The disadvantages of the known prior art are to be avoided with a turbine blade arrangement according to the present invention.

In a turbine blade according to the present invention, the turbine blade is provided with heat localization segments. The turbine blade is especially intended for a gas turbine and further comprises a plurality of covering elements. The covering elements may be formed of one piece with the turbine blade and impede access of a hot working medium to the turbine rotor.

BRIEF DESCRIPTION OF THE DRAWINGS

A preferred embodiment of the present invention is described with reference to the accompanying drawings wherein like members bear like reference numerals and wherein.

DETAILED DESCRIPTION OF A PREFERRED EMBODIMENT OF THE PRESENT INVENTION

Figure 1:
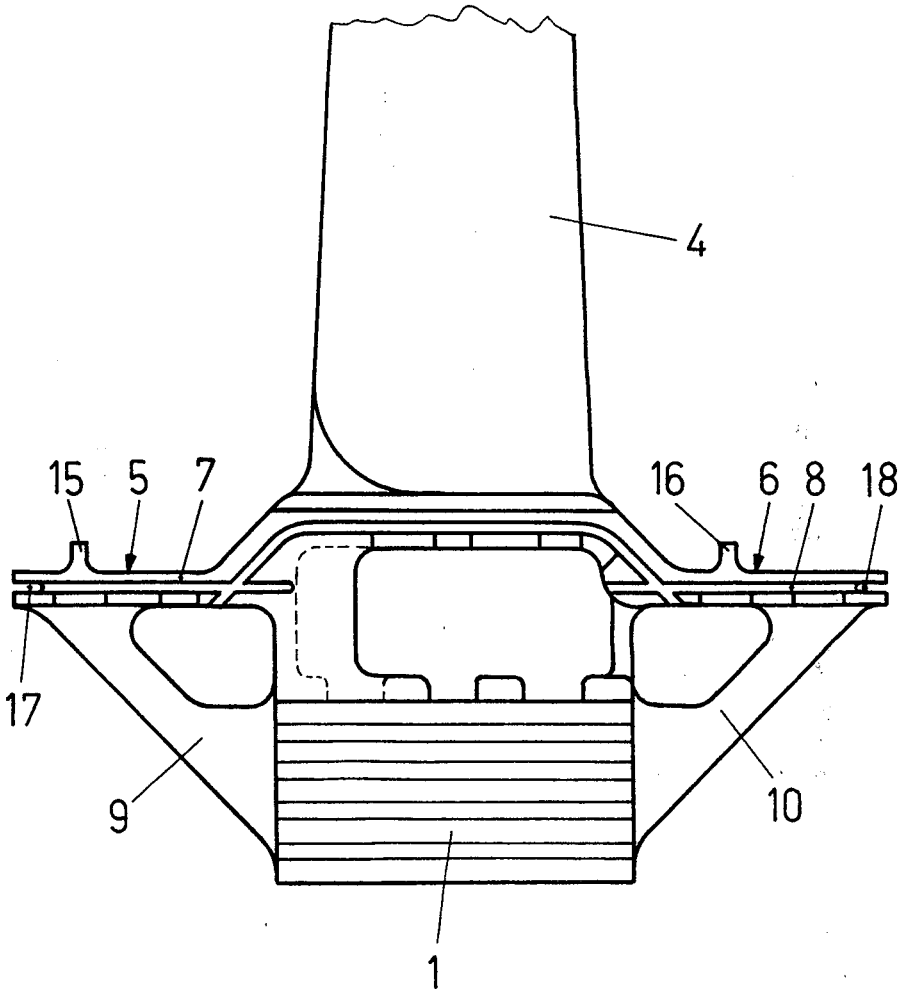
FIG. 1 is a partial side view of a turbine blade according to the present invention along a line normal to the rotor axis.
Figure 2:
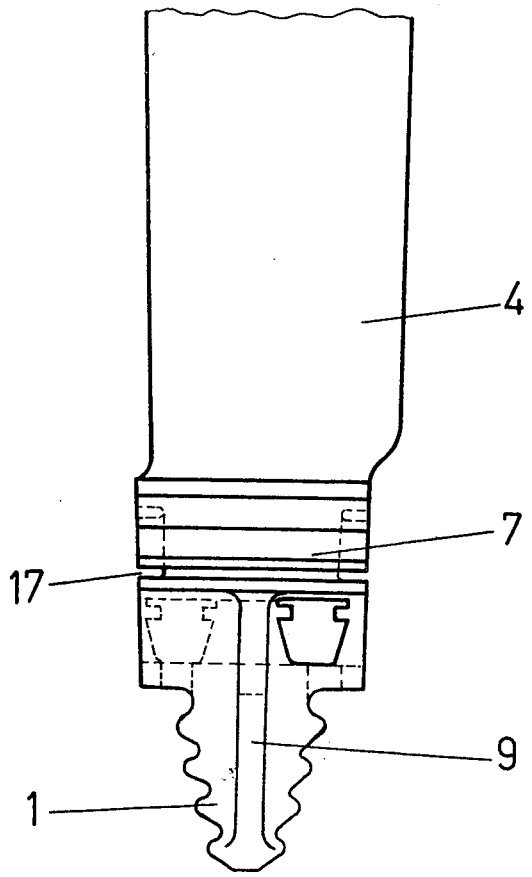
FIG. 2 is a partial side view of the turbine blade of FIG. 1 along a line parallel with the rotor axis; and, FIG. 3 is a view of a portion of the blading of a gas turbine according to the present invention.
Figure 3:
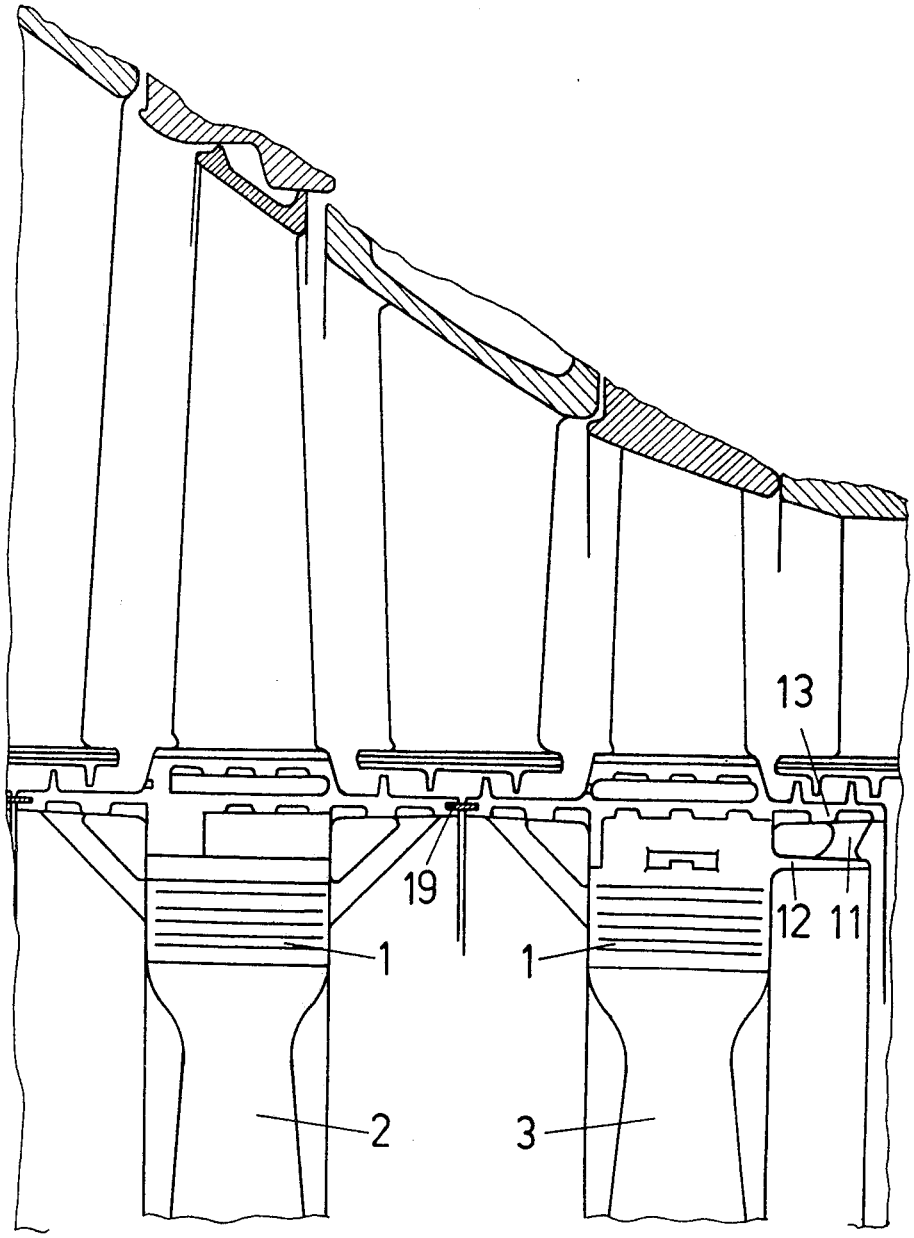

With reference to FIG. 1, a rotor according to the present invention has a fir cone root 1 for fastening longitudinal slots parallel to the axis of the rotor on the circumference of associated rotor disks 2 and 3 (see FIG. 3). At a transition point from a blade root into a blade 4 (see FIG. 1), heat localization segments 5 and 6 in the form of reinforced brackets extend in the longitudinal direction of the rotor axis. That is, the segments extend in the direction of impingement of gases on the blade. The segments are formed integral with the blade 4 as one piece. The heat localization segments each include a cover plate 7, 8 and supports such as oblique braces 9, 10 which support against the blade root 1. The cover plates 7, 8 are kept quite thin in the interest of providing as little additional centrifugal force as possible. In the preferred embodiment illustrated in FIG. 1, the support is arranged as a brace having a rectangular cross section. The support could, however, also assume other forms as desired. For example, the support may be arranged as a triangular rib having a rectangular cross section, or as shown in FIG. 3 as an intermediate brace 11 provided between a supporting plate 12 and a cover plate 13. In the event that the guide blades 14 are provided with shrouding (as in the arrangement of the blading shown in FIG. 3) the cover plates 7, 8 are preferably provided with sealing ridges 15, 16 (see FIG. 1). In order to seal expansion joints between two adjacent blade rows and between two adjacent blades of a row, the cover plates 7 and 8 are preferably provided with slots 17 and 18 in which sealing strips 19 (see FIG. 3) made of a highly heat-resistant material are inserted. Customarily, a screen of cooling air is blown in the longitudinal direction of the rotor through a canal system (not shown) in the blades underneath the covering thus formed. In this way, the protection of the actual shaft from the hot gases is further improved.

The manufacture of such blades by precision casting indeed necessitates high casting-engineering requirements but, however, such an arrangement does remove the problems which are connected with the mounting of separate heat localization segments. These problems include, for example, the treatment of fitting joints and the accommodation of mounting elements within a restricted area.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A blade for a turbine section, of a gas turbine, comprising:

a blade root;

a blade member extending directly from the blade root;

first and second heat localization segments including first and second covering elements respectively, the first and second covering elements being formed as one piece with the blade member and the blade root, said covering elements impeding access of a working medium to a rotor of the turbine;

each covering element including a cover plate and supporting means for stiffening the cover plate, a portion of the cover plate adjacent the blade member and blade root being angled toward the blade member, said supporting means connecting the cover plate to an axial end face of the blade root.

2. The blade of claim 1 wherein the supporting means includes first and second braces.

3. The blade of claim 1 wherein the supporting means includes first and second triangular shaped ribs.

4. The blade of claim 1 wherein the supporting means includes a bracket plate and an intermediate brace connecting the bracket plate with one of the cover plates.

5. The blade of claim 1 wherein the first and second covering elements each include slot means for receiving a sealing strip to seal an expansion joint between adjacent blades.

6. The blade of claim 1 wherein the first and second covering elements are each provided with at least one sealing ridge.

* * * * *